US005900153A

United States Patent [19]

Sanford

[11] Patent Number: 5,900,153

[45] Date of Patent: May 4, 1999

[54] DEVICE WITH GRANULAR CARBON FILTER MEDIUM FOR PURIFICATION OF GASOLINE USED IN THE INTERNAL-COMBUSTION ENGINE

[76] Inventor: Sterling D. Sanford, P.O. Box 1521, Rowlett, Tex. 75030-1521

[21] Appl. No.: 08/779,252

[22] Filed: Jan. 3, 1997

Related U.S. Application Data

[63] Continuation of application No. 08/293,890, Aug. 22, 1994, abandoned.

[51] Int. Cl.[6] ..... B01D 15/00

[52] U.S. Cl. ..... 210/690; 210/282

[58] Field of Search ..... 210/694, 282, 210/690, 416.4

[56] References Cited

U.S. PATENT DOCUMENTS

| | | | |
|---|---|---|---|
| 3,730,347 | 5/1973 | Giampalmi et al. | 210/282 |
| 4,048,064 | 9/1977 | Clark | 210/282 |
| 5,064,805 | 11/1991 | Otowa | 502/437 |
| 5,094,747 | 3/1992 | Johnson | 210/282 |
| 5,182,018 | 1/1993 | Langston | 210/282 |

OTHER PUBLICATIONS

"Activated Carbon, Type PC, Cocunut Shell Carbon", Barneby & Sutcliffe Corp., Product Information and Material Safety Data Sheet.

*Primary Examiner*—Ivars Cintins

[57] ABSTRACT

A device for purifying gasoline by separating the paraffins and varnishes that when burned through an internal-combustion engine cause air pollution. The device includes a inlet fitting (1), a removable cap (2) or non-removable cap (8), a filter shell (4), a granular filter medium (7), a non-removable cap (5) and an outlet fitting (6). The gasoline enters the device and comes in contact with the granular carbon filter medium and then exits the device and proceeds on to the gasoline distribution system.

3 Claims, 8 Drawing Sheets

DEVICE WITH GRANULAR CARBON FILTER MEDIUM FOR PURIFICATION OF GASOLINE USED IN THE INTERNAL-COMBUSTION ENGINE

This is a continuation of copending application Ser. No. 08/293,890 filed on Aug. 22, 1994, now abandonded.

BACKGROUND-FIELD OF INVENTION

The invention relates to a device for separating paraffins, varnishes, coarse and/or fine particles from gasoline.

BACKGROUND-DESCRIPTION OF RELATED ART

This device includes an inlet fitting, a removable or non-removable cap, a filter shell, a granular filtering medium filling the interior of the filter shell through which the gasoline must flow, a non-removable cap and an outlet fitting through which the purified gasoline must exit the filter shell.

In order to purify the gasoline laden with paraffins, varnishes, coarse and fine particles a granular filter medium is used, If a removable cap is used the filter medium may be removed and discarded then a replacement filter medium can be installed. If a non-removable cap is used the entire device must be discarded and replaced with a new device.

All other devices along these lines simply remove particulate material from the gasoline flow. They make no attempt to remove the varnish and paraffins from the gasoline. These varnishes and paraffins are the cause of hydrocarbons and carbon monoxide production from the internal combustion engine. With these elements removed from the gasoline the internal combustion engine can become virtually pollution free. The other gasoline filters use paper or rock type filter medium and not a granular filter medium of 12×30 U.S. mesh, activated carbon, type PC, 7440-44-0, coconut shell carbon, CCL4. This carbon filters the gasoline to a higher quality than the refineries do. This makes for a cleaner burning gasoline. There are no other known devices with the same design or function on the market, except patent application Ser. No. 29/017,485 which is "Air Pollution Reduction fuel filter for the internal-combustion engine", primary class D-23, which I Sterling D. Sanford, Rowlett, Tex., applied for on filing date Jan. 14, 1994.

OBJECTS AND ADVANTAGES

Accordingly, several objects and advantages of my invention are the purification of gasoline for the reduction of air pollution from the internal-combustion engine.

The separation of paraffins and varnishes from gasoline is important because when burned in the internal-combustion engine these substances form hydrocarbons to pollute the air and carbon that becomes burned onto the valves and cylinder areas. These carbon deposits cause valves to burn preventing proper compression and combustion or the fuel air mixture, causing unburned and partially burned fuel to escape the combustion chamber and into the air as pollution. Carbon deposits stick to the combustion chamber walls where the rings scrape them loose and the oil washes them away to the crank case. This causes the oil to become dirty and deteriorates it's lubricating properties, causing shorter engine life.

By filtering or purifying the gasoline before it enters the engine fuel delivery system, the problems can be prevented. When an engine is not in operation gasoline stands stagnant in the fuel delivery system. ie.,(carburetor or fuel injection system). Varnish becomes attached to these items and prevents them from operating properly. Filtering or purifying the gasoline before it reaches these items will help prevent these malfunctions.

This filtering or purifying of the gasoline is accomplished by allowing the gasoline to come in contact with a granular filter medium of 12×30 mesh, activated carbon, type PC carbon 7440-44-0, Coconut shell carbon, CCL4, and out to the fuel distribution system for the engine.

This purified gasoline then burns clean in the cylinders, the exhaust that exits the tail pipe is greatly reduced or in some cases the carbon monoxide and hydrocarbons are completely removed. The novel features which are considered as characteristic for the invention are set forth in particular in the claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
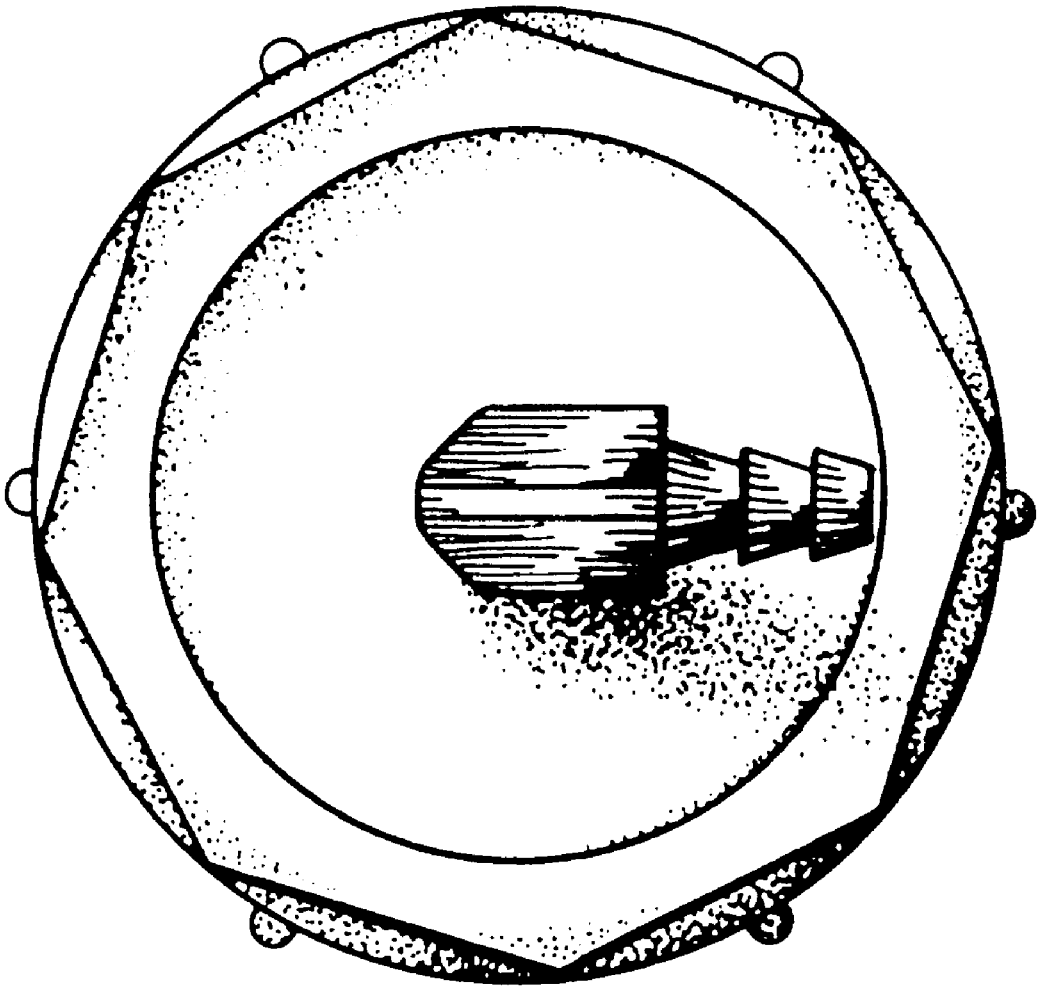
FIG. 1: Top view of removable cap on device pursuant to the present invention.

The removable cap device (9, FIG. 2), and the non-removable cap device (10, FIG. 5), consists of a filter shell (4) bonded with pvc glue to a non-removable cap (5) mounted on bottom. This non-removable cap (5) has a hole drilled in the center to accomodate a ⅜" tap tool for threading the hole to accept the ⅜ pipe thread end of the 90 deg. fitting to be used as a gasoline outlet. The removable cap (2, FIG. 2) that screws into base (3 FIG. 2) bonded on top of the filter shell (4) or a non-removable cap (8, FIG. 5), bonded with pvc glue on top of the filter shell (4) also have a hole drilled in their centers to accomodate a ⅜" tap tool for threading the hole to except the ⅜" pipe thread end of the 90 deg. fitting to be used as a gasoline inlet. Both the non-removable cap (5), bonded on bottom of each unit, and the removable cap (2 FIG. 2) or the non-removable cap (8 FIG. 5) incorporate a 90 deg. fitting with a 5/16 hose barb on one end and a ⅜ pipe thread on the other end as a gasoline inlet (1) and a outlet (6).

Located inside the shell is a granular filter element (7) consisting of one half pound (½ lbs) (54.24 sq. in. of surface area) activated carbon, type PC, carbon 7440-44-0, coconut shell carbon, 12×30 U.S. mesh, CCL4, encased in nylon mesh tube tied at both ends to prevent the filter medium from exiting through gasoline outlet (6).

Figure 2:
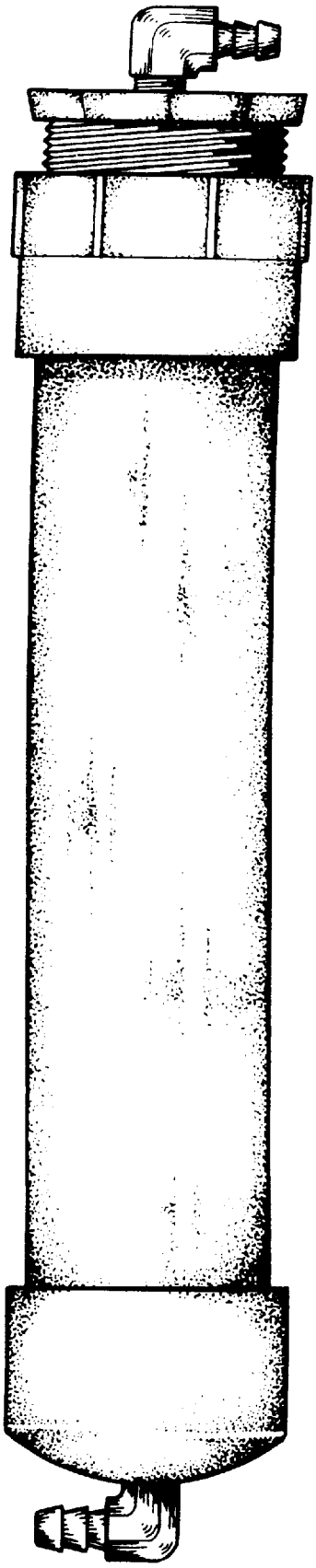
FIG. 2: Side view of device with removable cap.
Figure 3:
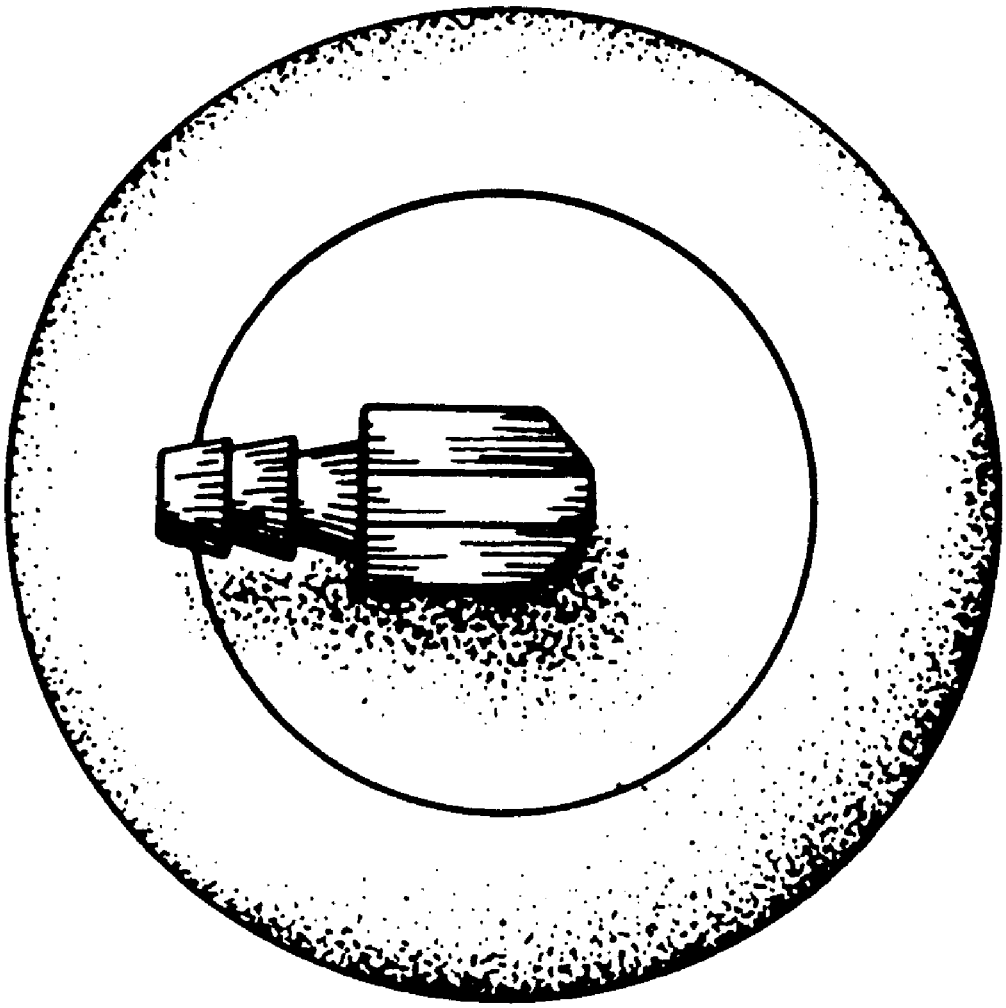
FIG. 3: Bottom view of device pursuant to the present invention.
Figure 4:
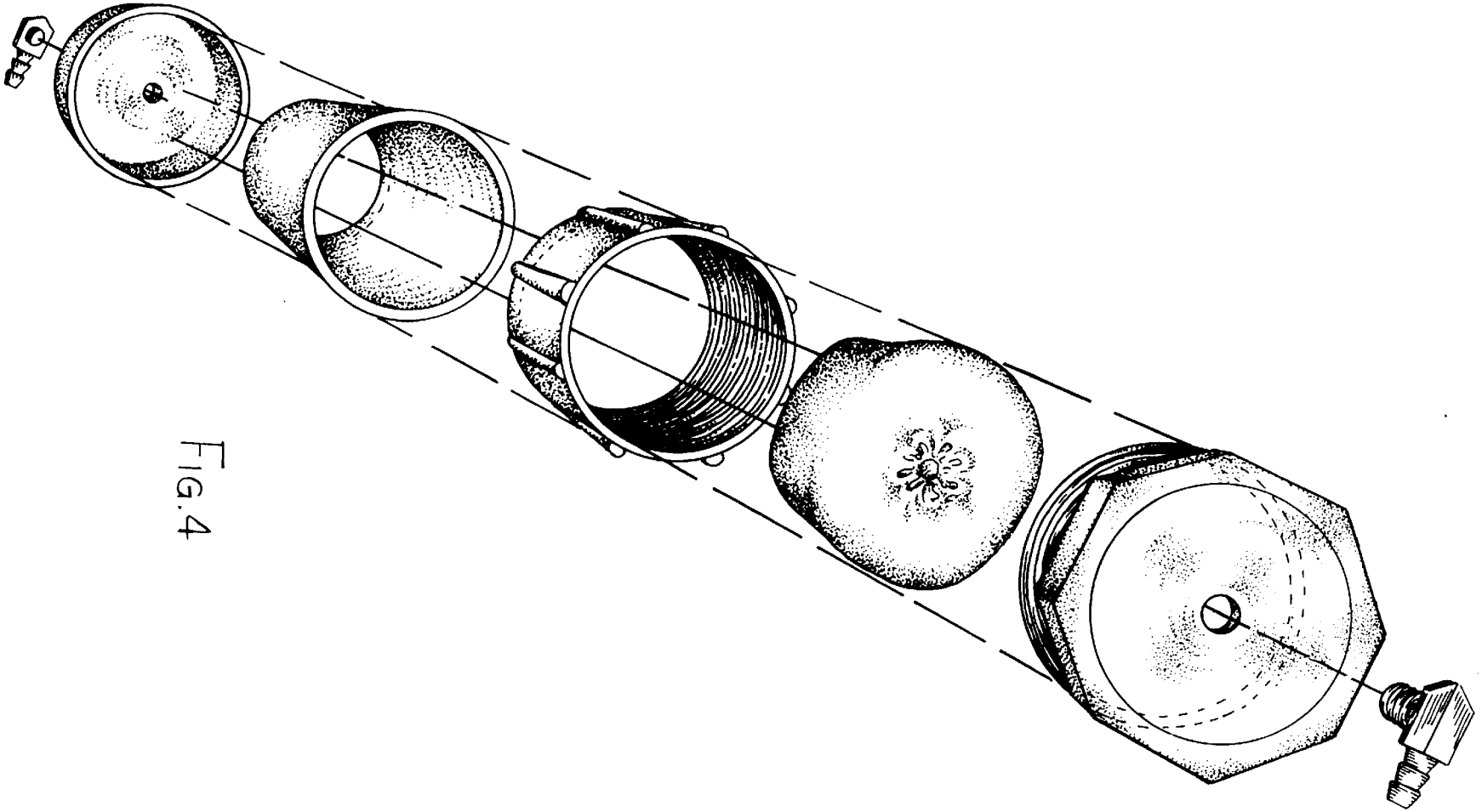
FIG. 4: Isometric exploded view of device with removable cap.
Figure 7:
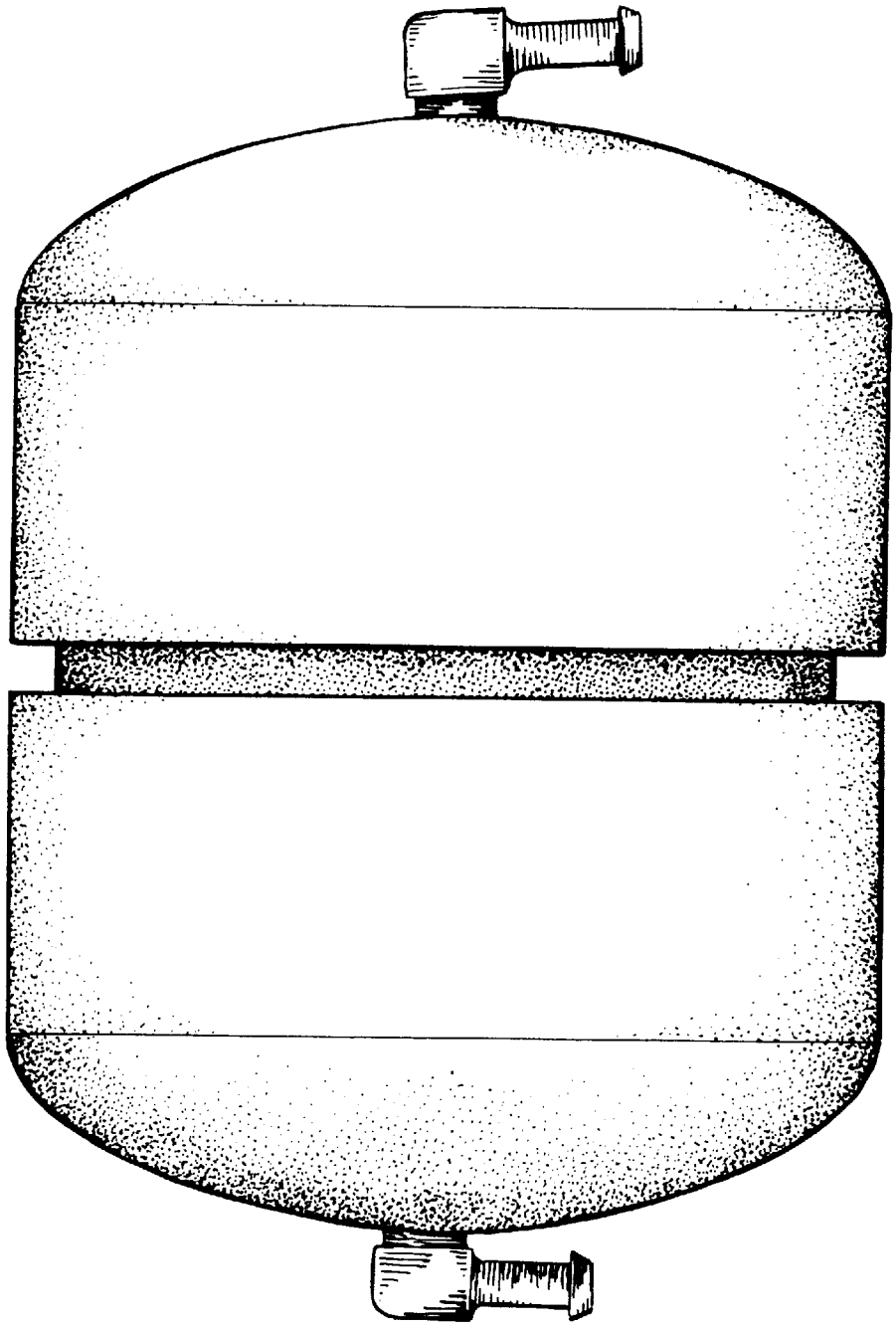
FIG. 7: Side view of alternate design of device pursuant to the present invention.
Figure 8:
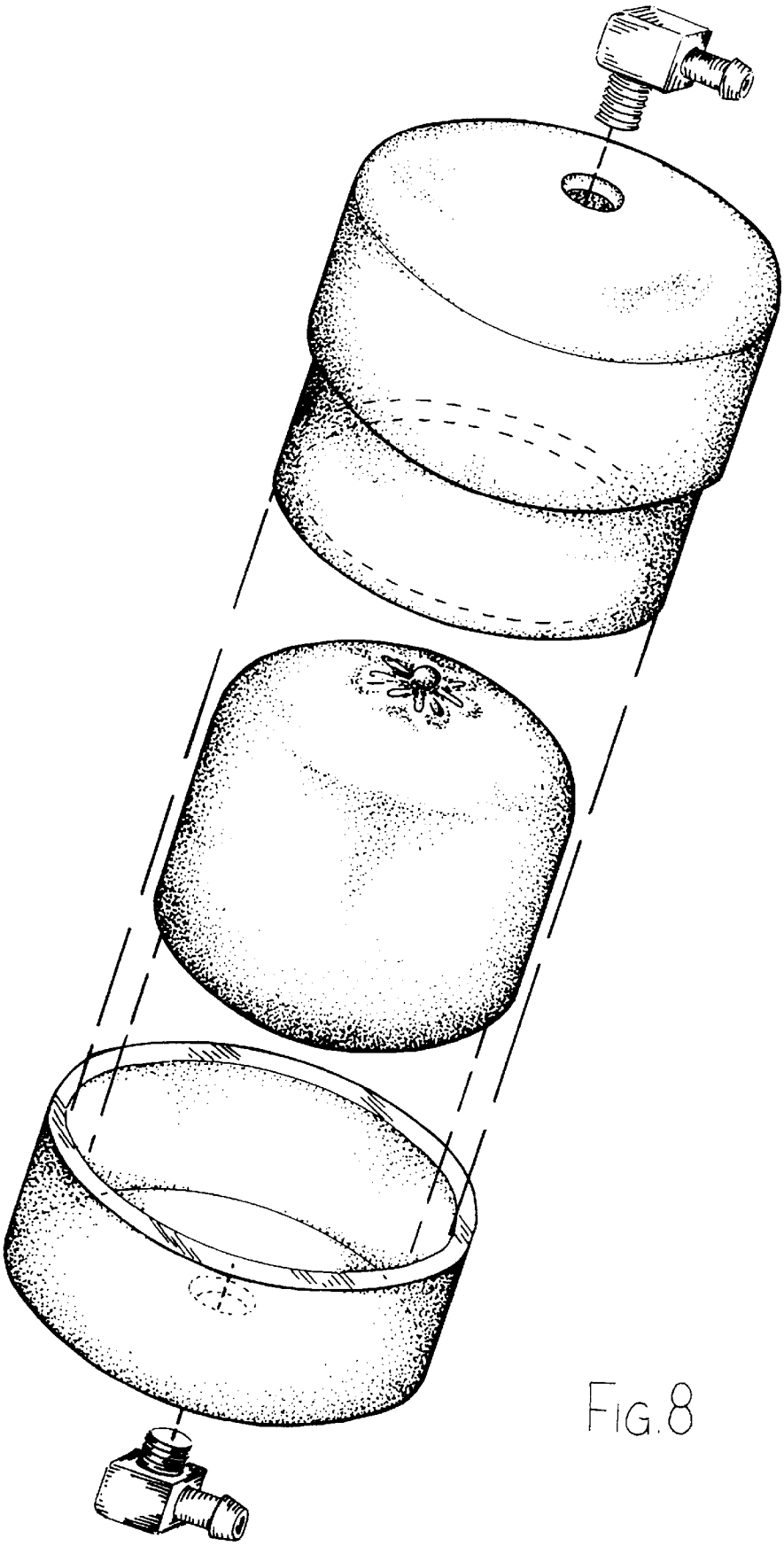
FIG. 8: Isometric exploded view of alternate design of device.

The granular filter element (7) encased in the shell (4) with non-removable cap (5) and removable cap (2, FIG. 2)

or non-removable cap (8, FIG. 5) both incorporating the 90 deg. fitting (1) and (6) all bonded and properly fitted together into their respective locations make-up the device (9, FIG. 2), (10, FIG. 5) and (11 FIG. 7).

Operation-FIGS. 2,4,5,6, and 8

Figure 5:
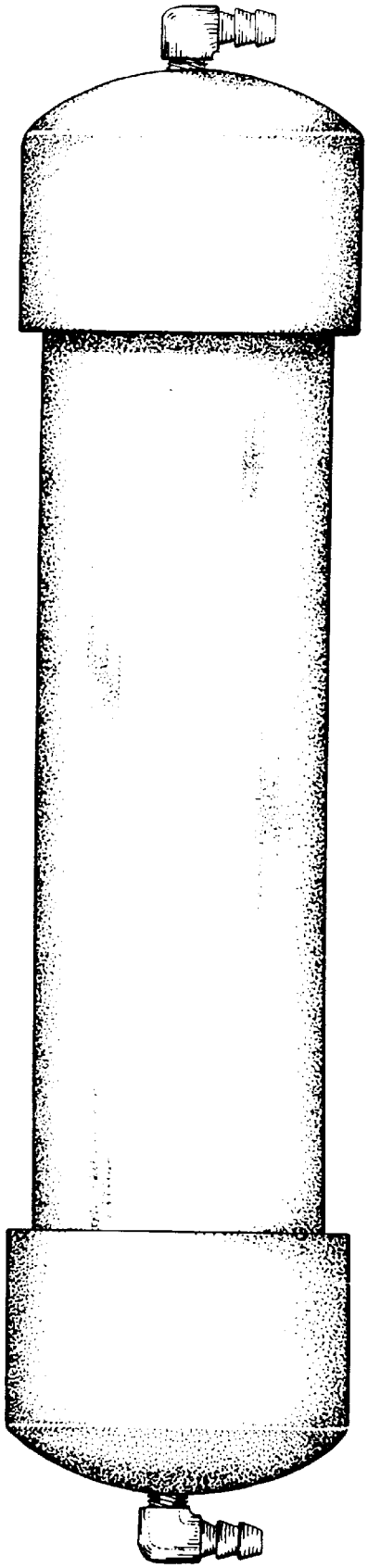
FIG. 5: Side view of device with non-removable cap.
Figure 6:
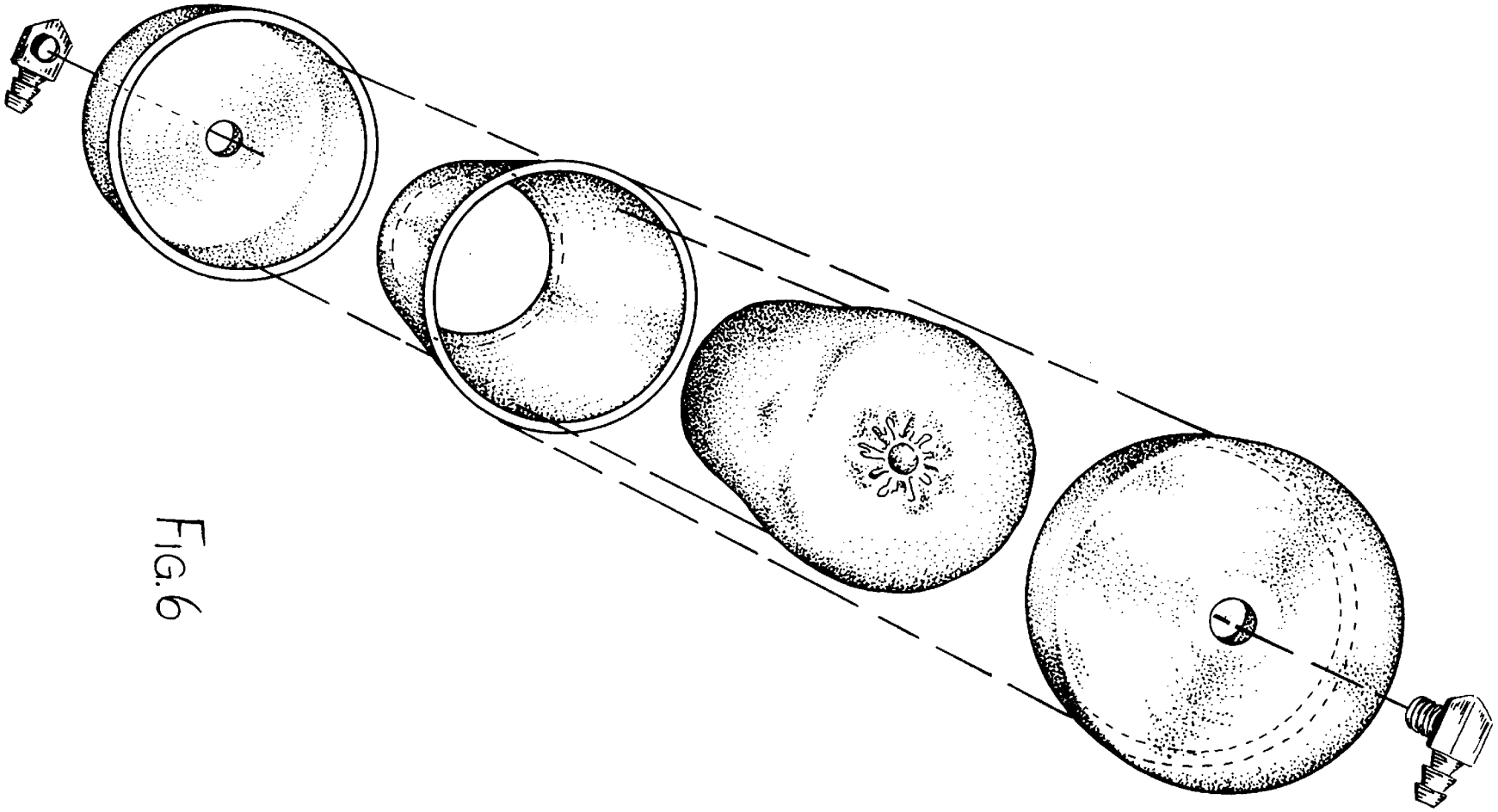
FIG. 6: Isometric exploded view of device with non-removable cap.

The following process takes place in the device (9, FIG. 2) or device (10, FIG. 5). The gasoline entering through inlet (1) flows into the filter shell (4) where it comes in contact with the granular filter medium (7). The gasoline flows through the granular filter medium (7). At this point the granular filter medium filters the gasoline to remove the paraffins and varnishes along with coarse and/or fine particles. The purified gasoline then flows through the outlet (6) and on to the gasoline distribution system mounted on the internal combustion engine.

Over a period of 15,000 to 20,000 miles the filtering process slows to the point the hydrocarbon and carbon monoxide level will start to increase. When this happens the granular filter element (7) is replaced on the removable filter unit (9, FIG. 2) or the whole unit is replaced on the non-removable unit (10, FIG. 5).

While the invention has been illustrated and described as embodied in a device with granulated filter for gasoline purification it is not intended to be limited to the details shown, since various modifications and structural changes may be made without departing in any way from the spirit of the present invention. Without further analysis, the foregoing will so fully reveal the gist of the present invention that others can,by applying current knowledge, readily adapt it for various applications without omitting features that fairly constitute essential characteristics of the generic or specific aspects of this invention. Accordingly, the scope of the invention should be determined not by the embodiment (s) illustrated, but by the appended claims and their legal equivalents.

What is claimed as new and desired to be protected by patent is set forth in claim below:

1. A method of purifying gasoline by removing paraffins and varnish from the gasoline comprising:

enclosing with a porous material a filter element comprising approximately 0.5 pounds of granular activated coconut shell carbon; and passing the gasoline through the porous material and the filter element such that paraffins and varnish are removed from the gasoline, thereby purifying the gasoline.

2. A method according to claim 1 wherein the activated coconut shell carbon has an aggregate size of 12 by 30 mesh.

3. A method according to claim 1 wherein the porous material is a nylon mesh.

* * * * *